US007027756B2

(12) United States Patent
Hoshi et al.

(10) Patent No.: US 7,027,756 B2
(45) Date of Patent: Apr. 11, 2006

(54) PROCESS CARTRIDGE AND ASSEMBLYING METHOD THEREFOR

(75) Inventors: Nobuharu Hoshi, Numazu (JP); Susumu Nittani, Shizuoka-ken (JP); Tatsuya Suzuki, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/878,616

(22) Filed: Jun. 29, 2004

(65) Prior Publication Data

US 2005/0117935 A1 Jun. 2, 2005

(30) Foreign Application Priority Data

Nov. 28, 2003 (JP) ..... 2003-400799

(51) Int. Cl.
*G03G 15/08* (2006.01)
*G03G 21/16* (2006.01)

(52) U.S. Cl. ..... 399/111; 399/113; 399/119; 399/167

(58) Field of Classification Search ..... 399/107, 399/109, 111, 113, 119, 167
See application file for complete search history.

(56) References Cited

U.S. PATENT DOCUMENTS

| | | | | |
|---|---|---|---|---|
| 5,966,566 | A | 10/1999 | Odagawa et al. | 399/109 |
| 6,078,763 | A | 6/2000 | Hoshi | 399/111 |
| 6,442,359 | B1 | 8/2002 | Numagami et al. | 399/111 |
| 6,459,869 | B1 | 10/2002 | Nittani et al. | 399/111 |
| 6,463,233 | B1 | 10/2002 | Kojima et al. | 399/111 |
| 6,463,234 | B1 | 10/2002 | Arimitsu et al. | 399/113 |
| 6,577,831 | B1 | 6/2003 | Kojima et al. | 399/111 |
| 6,681,088 | B1 | 1/2004 | Kanno et al. | 399/111 |
| 6,836,629 | B1 * | 12/2004 | Miyabe et al. | 399/111 |
| 6,865,357 | B1 * | 3/2005 | Fujita et al. | 399/111 |
| 6,941,092 | B1 * | 9/2005 | Yokoi | 399/109 |
| 2002/0141788 | A1 | 10/2002 | Matsuda et al. | 399/260 |
| 2003/0133723 | A1 | 7/2003 | Fujita et al. | 399/111 |
| 2003/0156855 | A1 | 8/2003 | Nittani et al. | 399/106 |

FOREIGN PATENT DOCUMENTS

| | | |
|---|---|---|
| EP | 0 907 114 A2 | 4/1999 |
| EP | 1 223 475 A1 | 7/2002 |

* cited by examiner

*Primary Examiner*—Hoang Ngo
(74) *Attorney, Agent, or Firm*—Fitzpatrick, Cella, Harper & Scinto

(57) ABSTRACT

A process cartridge, detachably mountable to a main assembly of an electrophotographic image forming apparatus includes an electrophotographic photosensitive drum; a developer accommodating portion; a developing roller for developing a latent image formed on the drum using the developer accommodated in the accommodating portion; a developer supply roller; a developing device frame supporting the developing roller and the developer supply roller and having the developer accommodating portion; a first gear having a driving force receiving gear portion which is engaged with a main assembly gear when the process cartridge is mounted to the main assembly; a second gear provided inside the driving force receiving gear portion in a longitudinal direction of the developing device frame and being effective to transmit the driving force received by the first gear to the developer supply roller; and a supporting member, disposed between the first gear and the second gear with respect to the longitudinal direction of the developing device frame, for supporting the second gear.

20 Claims, 12 Drawing Sheets

PROCESS CARTRIDGE AND ASSEMBLYING METHOD THEREFOR

FIELD OF THE INVENTION AND RELATED ART

The present invention relates to a process cartridge removably mountable in the main assembly of an electrophotographic image forming apparatus and an assemblying method for the process cartridge.

Here, an electrophotographic image forming apparatus is an apparatus for forming an image on recording medium, with the use of one of the electrophotographic image formation processes. For example, it includes an electrophotographic copying machine, an electrophotographic printer (for example, laser beam printer, LED printer, etc.), an electrophotographic facsimile apparatus, etc.

A process cartridge is a cartridge in which a minimum of a developing means as a processing means, and an electrophotographic photosensitive member are integrally disposed, and which is removably mountable in the main assembly of an electrophotographic image forming apparatus.

In the field of an electrophotographic image forming apparatus employing one of the electrophotographic image formation processes, it has been a common practice to employ a process cartridge system, which integrally places an electrophotographic photosensitive member, and a single or plurality of processing means, which act on an electrophotographic photosensitive member, in a cartridge removably mountable in the main assembly of an electrophotographic image forming apparatus. The employment of this process cartridge system makes it possible for a user himself to maintain an electrophotographic image forming apparatus, without help from service personnel, drastically improving the apparatus in operational efficiency. Thus, a process cartridge system has been widely used in the field of an electrophotographic image forming apparatus.

As is known (U.S. Pat. No. 5,966,566), in a process cartridge, a bearing member for supporting process means, gears of drive transmission means for receiving a driving force from the main assembly to drive the process cartridge, and a side cover, are assembled from each of opposite longitudinal ends thereof.

SUMMARY OF THE INVENTION

The primary object of the present invention is to provide a process cartridge which can be downsized, and a process cartridge assemblying method therefor.

Another object of the present invention is to provide a process cartridge and a process cartridge assemblying method, wherein a first gear having a driving force receiving gear portion for receiving the driving force through engagement with a main assembly gear, and a second gear for transmitting the driving force received by the first gear to a developer supply roller, can be supported accurately.

A further object of the present invention is to provide a process cartridge which has a structure convenient in assemblying, and an assemblying method therefor.

According to an aspect of the present invention, there is provided a process cartridge detachably mountable to a main assembly of an electrophotographic image forming apparatus, the process cartridge comprising an electrophotographic photosensitive drum; a developer accommodating portion for accommodating a developer; a developing roller for developing an electrostatic latent image formed on the electrophotographic photosensitive drum using the developer accommodated in the accommodating portion; a developer supply roller for supplying the developer to the developing roller; a developing device frame supporting the developing roller and the developer supply roller and having the developer accommodating portion; a first gear provided at one longitudinal end side of the developing device frame, the first gear having a driving force receiving gear portion which is engaged with a main assembly gear provided in the main assembly of the image forming apparatus when the process cartridge is mounted to the main assembly of the image forming apparatus; a second gear provided inside the driving force receiving gear portion in a longitudinal direction of the developing device frame, the second gear being effective to transmit the driving force received by the first gear to the developer supply roller; and a supporting member, disposed between the first gear and the second gear with respect to the longitudinal direction of the developing device frame, for supporting the second gear.

According to another aspect of the present invention, there is provided an assembling method for a process cartridge detachably mountable to a main assembly of an electrophotographic image forming apparatus, wherein the process cartridge includes an electrophotographic photosensitive drum, a developer accommodating portion for accommodating a developer, developing roller for developing an electrostatic latent image formed on the electrophotographic photosensitive drum using the developer accommodated in the developer accommodating portion, a developer supply roller for supplying the developer to the developing roller, and a developing device frame supporting the developing roller and the developer supply roller and having the developer accommodating portion, the method comprising (i) a roller mounting step of mounting the developing roller and the developer supply roller to the developing device frame; (ii) a second gear mounting step of mounting second gear to the developing device frame, wherein the second gear is effective to transmit a driving force received by a first engaged with a main assembly gear provided in the main assembly of the image forming apparatus to the developer supply roller; (iii) a supporting member mounting step of mounting a supporting member to the developing device frame to support the second gear by the supporting member after the second gear mounting step, wherein the supporting member is disposed between the first gear and the second gear with respect to a longitudinal direction of the developing device frame to support the second gear; and a first gear mounting step of mounting the first gear to the developing device frame after the supporting member mounting step.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

[Description of General Structure of Image Forming Apparatus]

Figure 1:
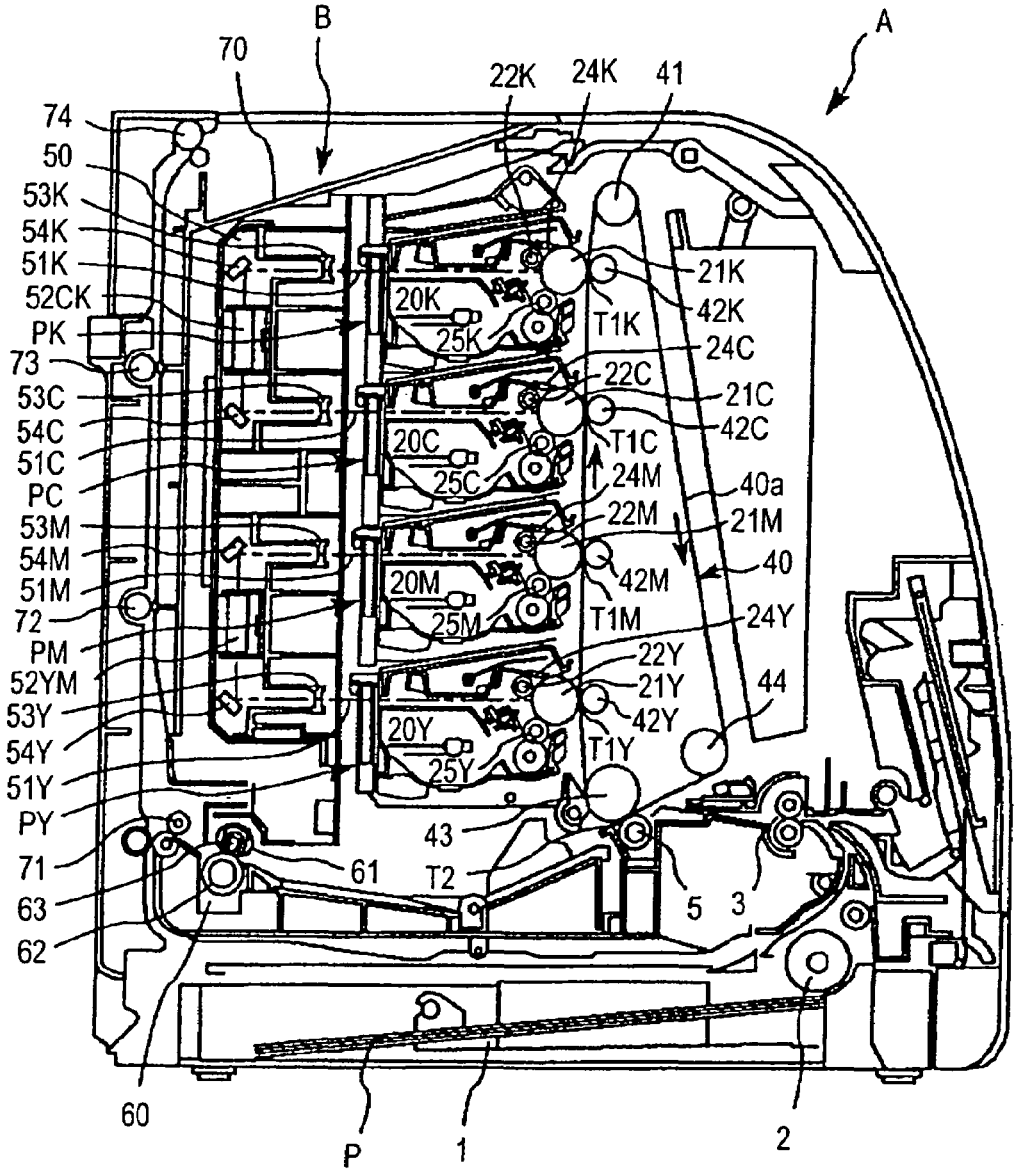
FIG. 1 is a sectional view of the image forming apparatus in one of the preferred embodiments of the present invention, showing the general structure thereof.

First, referring to FIG. 1, a color image forming apparatus as an example of an image forming apparatus in which a process cartridge is removably mountable will be roughly described regarding its general structure. The color image forming apparatus in this embodiment is a color laser printer.

In this embodiment, the color laser printer A has four image formation stations PY, PM, PC, and PK, which employ yellow Y, magenta M, cyan C, and black K process cartridges 20 (20Y, 20M, 20C, 20K), respectively, and has an intermediary transfer unit 40 for temporarily holding a color image formed through multilayer transfer of a plurality of visible images (image formed of toners), as shown in FIG. 1. The four process cartridges 20 are individually and removably mountable in the main assembly B of the printer.

Figure 2:
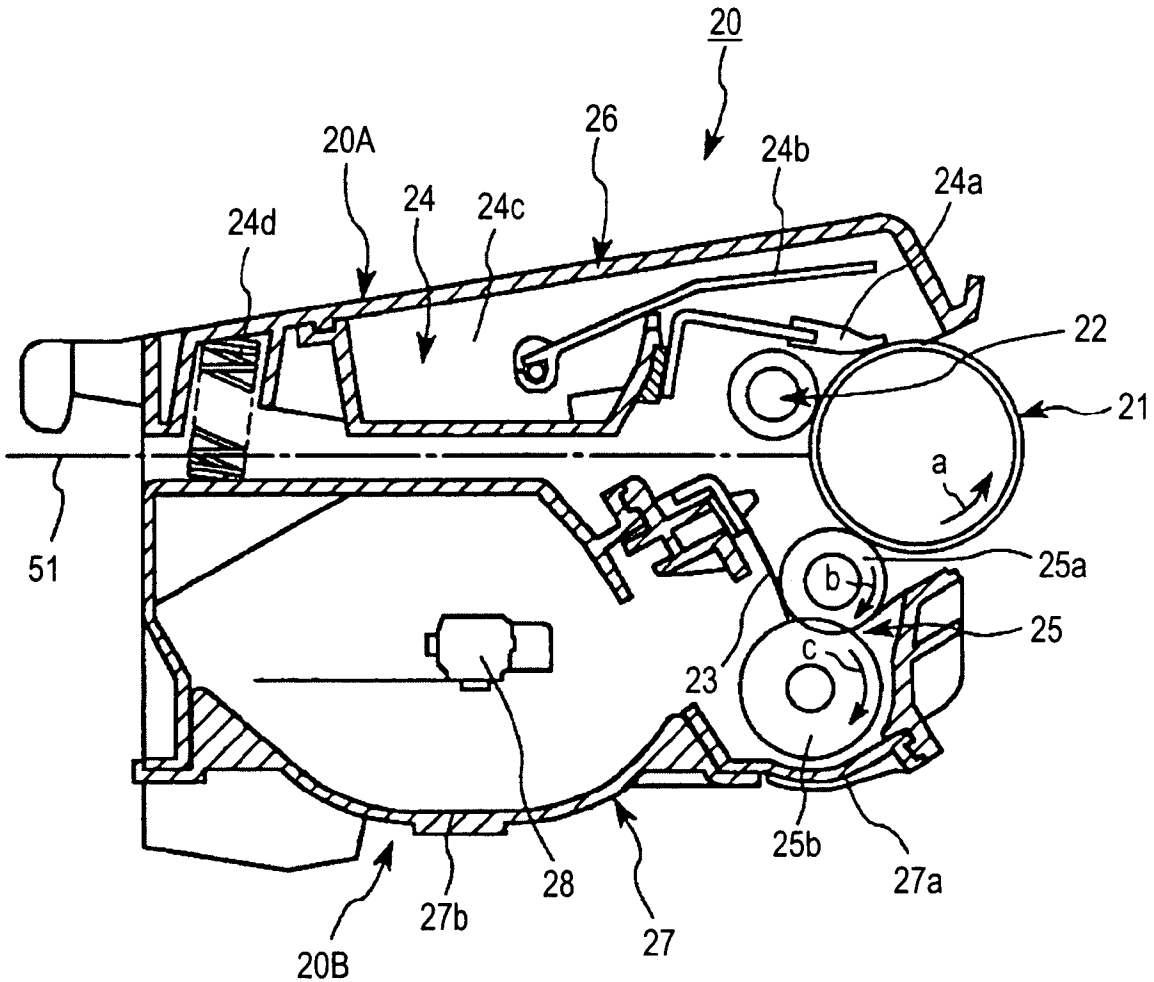
FIG. 2 is a sectional view of a process cartridge, showing the structure thereof.

Referring to FIG. 2, each process cartridge 20 (20Y, 20M, 20C, and 20K) is provided with an electrophotographic photosensitive drum 21 (21Y, 21M, 21C, and 21K) (which hereinafter will be described simply as "photosensitive drum") which is rotated at a predetermined peripheral velocity, a charging means 22 (22Y, 22M, 22C, and 22K), a developing means 25 (25Y, 25M, 25C, and 25K), and a cleaning means 24 (24Y, 24M, 24C, and 24K). A process cartridge 20 forms a toner image on the photosensitive drum 21. An exposing means 50 is a part of the main assembly B of the apparatus. The unit 40 conveys the color toner images, which the unit 40 is holding, to the transfer station, in which the color toner images are transferred onto a recording medium P conveyed from a recording medium feed station.

After the transfer of the color toner images onto the recording medium P, the recording medium P is conveyed to the fixation station 60, in which the toner images are fixed to the recording medium P. Thereafter, the recording medium P is discharged by a group of discharge roller pairs 71, 72, 73, and 74, into the delivery tray 70 which constitutes a part of the top surface of the apparatus main assembly B.

Next, the various portions of the above described image forming apparatus will be described in detail regarding their structures, in the relevant order.

[Process Cartridge]

First, the structure of the process cartridge 20 (20Y, 20M, 20C, and 20K) will be roughly described. The cartridges 20Y, 20M, 20C, and 20K are the same in structure.

FIG. 2 is a sectional view of the cartridge 20. The cartridge 20 contains developer (toner), the amount of which is reduced by image formation, the photosensitive drum 21, and processing means such as a charge roller 22 as the charging means, a development roller 25*a* as the developing means 25, etc., making it possible to replenish the apparatus main assembly B with a fresh supply of developer, and/or replace together these processing means, by replacing the cartridge 20. The photosensitive drum 21, charging means 22, and developing means 25 will be described later in detail.

In other words, as the cartridge 20 runs out of toner, it is replaced, providing thereby the image forming apparatus with new processing components. Therefore, a high level of image quality is maintained.

The full-color image forming apparatus in this embodiment is of the in-line type, and employs four process cartridges, that is, yellow Y, magenta M, cyan C, and black K process cartridges 20 (20Y, 20M, 20C, 20K), which are different in the color of the developer they contain, and independent from each other, making it possible to individually replace the cartridges 20. Therefore, the four cartridges, whose service life differs, depending upon what kind of images are outputted by the image forming apparatus, can be more efficiently used.

Figure 3:
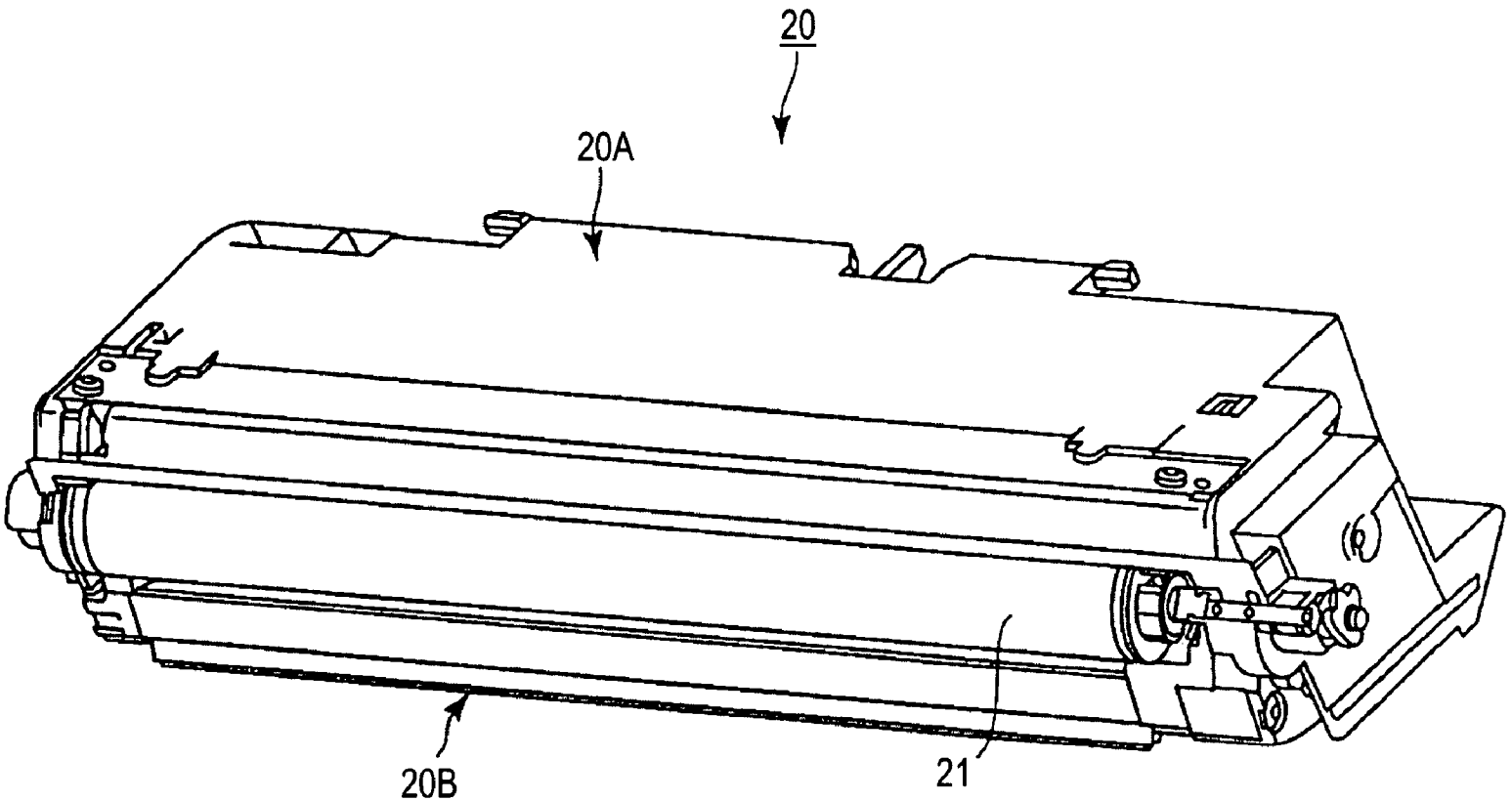
FIG. 3 is a perspective view of a process cartridge, showing the entirety thereof.
Figure 4:
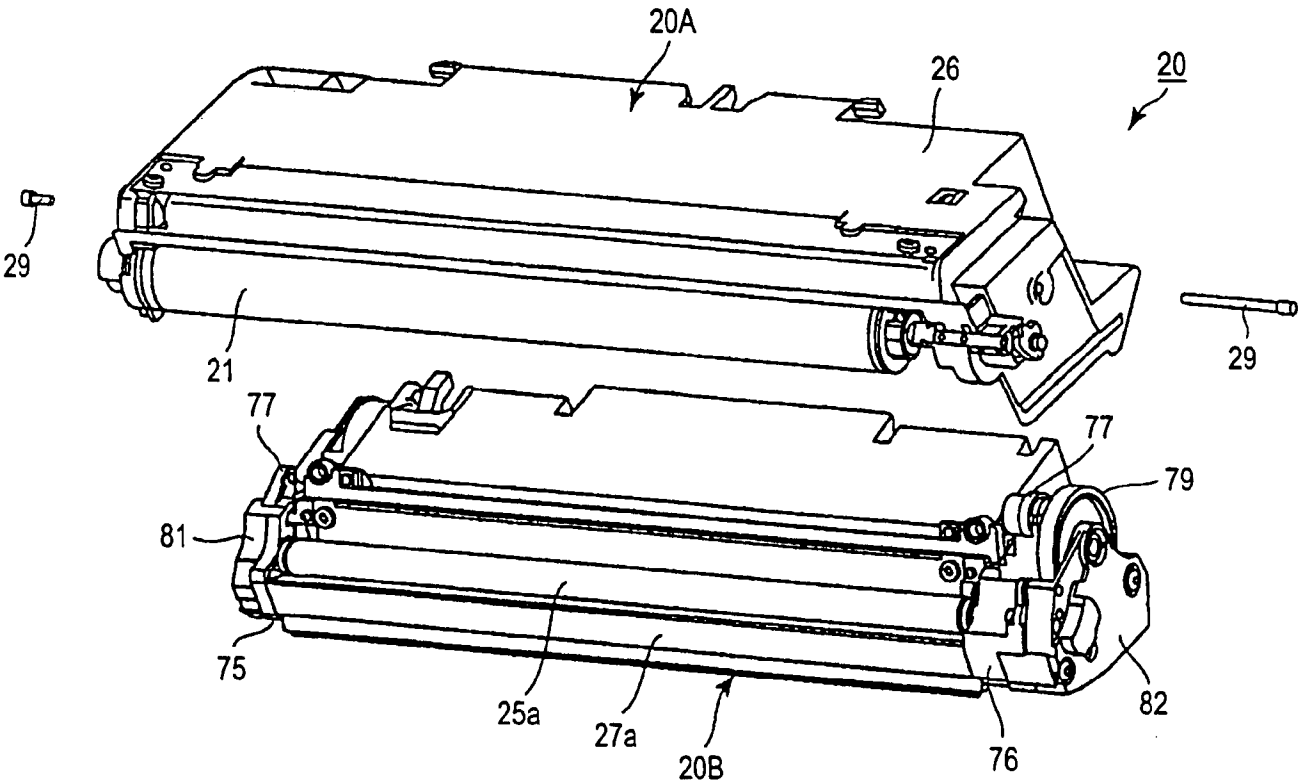
FIG. 4 is a perspective view of a process cartridge, the photosensitive drum unit and development unit of which are separated from each other.

Next, referring to FIGS. 3 and 4, the cartridge 20 (20Y, 20M, 20C, and 20K) in the preferred embodiment of the present invention will be described. FIG. 3 is a schematic perspective view of the cartridge 20, and FIG. 4 is a schematic perspective view of the partially disassembled cartridge 20. Incidentally, the yellow Y, magenta M, cyan C, and black K cartridges 20Y, 20M, 20C, and 20K are identical in structure.

The cartridge 20 is separable into a photosensitive drum unit 20A (which hereinafter will be referred to simply as "drum unit 20A") and a development unit 20B. The drum unit 20A comprises the photosensitive drum 21, the charging means 22, and the cleaning means 24. The development unit 20B comprises the developing means 25 for developing an electrostatic latent image formed on the photosensitive drum 21.

The drum unit 20A has a drum frame 26, to which the electrophotographic photosensitive drum 21 is rotatably attached, with the interposition of a pair of bearings (unshown). In the adjacencies of the peripheral surface of the photosensitive drum 21, the charge roller 22 as the primary charging means for uniformly charging the peripheral surface of the photosensitive drum 21, and a cleaning blade 24*a* for removing the residual developer (toner), that is, the developer (toner) remaining on the peripheral surface of the photosensitive drum 21, are disposed. The residual toner removed from the peripheral surface of the photosensitive drum 21 by the cleaning blade 24*a*, is sent by a toner conveying mechanism 24*b* to a waste toner chamber 24*c* located in the rear portion of the drum frame 26.

The photosensitive drum 21 is rotated in the counterclockwise direction (indicated by arrow mark a in FIG. 2) by a motor (unshown) in synchronism with the progression of an image forming operation.

The development unit 20B has a developer container 27, which includes a developing chamber or developing means container 27*a* provided with a developing roller 25*a* rotatable in a direction indicated by an arrow b by contact with the drum 21 and a toner container 27*b* containing a developer (toner).

The development roller 25*a* is rotatably supported by the developing means container 27*a*, with the interposition of a pair of bearing members 75 and 76. In the adjacencies of the peripheral surface of the development roller 25*a*, a developer (toner) supply roller 25*b* which is rotated in the direction indicated by an arrow mark c, in contact with the development roller 25*a*, and the development blade 23, are located.

In the toner container 27*b*, a stirring member 28 (which hereinafter may be referred to as "toner conveying member") for conveying the toner in the toner container 27*b* to the toner supply roller 25*b* while stirring the toner is disposed.

The development unit 20B is connected to the photosensitive drum unit 20A with the use of a pair of pins 29 inserted in the holes 77 of the bearing members 75 and 76 attached to the lengthwise ends of the development unit 20B, one for one, being enabled to oscillatorily move relative to the photosensitive drum unit 20A about the axial lines of the holes 77 (pins 29). Further, the development unit 20B is kept pressured by a pair of compression springs 24*d* so that the development roller 25*a* is kept in contact with the photosensitive drum 21 by the torque generated by the pair of compression springs 24*d* in the direction to rotate the development unit 20B about the axial lines of the holes 77 and pins 29.

[Electrophotographic Photosensitive Drum]

Each photosensitive drum 21 (21Y, 21M, 21C, 21K) comprises an aluminum cylinder, and a layer of organic photoconductive substance coated on the peripheral surface of the aluminum cylinder. The photosensitive drum 21 is placed in the drum frame 26, being supported by the drum frame 26. In other words, the drum unit 20A and the development unit 20B are integrally joined with each other, forming thereby the process cartridge 20.

Each cartridge 20 (20Y, 20M, 20C, and 20K) is removably supported by the printer main assembly 100, being enabled to be easily replaced as the service life of the photosensitive drum 21 therein expires, or the developer therein is depleted.

The method for attaching the photosensitive drum 21 in this embodiment of the present invention, and the matter related thereto, will be described later.

[Charging Means]

The charge roller 22 (22Y, 22M, 22C, and 22K) as a charging means is of a contact type. That is, the charge roller 22 is an electrically conductive roller, and is placed in contact with the peripheral surface of the photosensitive drum 21, so that as voltage is applied to the charge roller 22, the peripheral surface of the photosensitive drum 21 is uniformly charged.

[Exposing Means]

Referring to FIG. 1, the process for exposing the photosensitive drum 21 is carried out by a scanner as an exposing means 50.

The scanner in this embodiment has two polygon mirrors (52YM and 52CK) although the image forming apparatus is provided with the four image formation stations PY, PM, PC, and PK. As image formation signals are sent to a laser diode, the laser diode projects a beam of image formation light 51 (51Y, 51M, 51C, and 51K) modulated with the image formation signals, to the polygon mirrors (52YM and 52CK), which are being rotated at a high speed, and deflect (reflect) the beam of image formation light 51. The beam of image formation light 51 deflected by the polygon mirrors is changed in direction by a deflection (reflection) mirror (54Y, 54M, 54C, and 54K), travels through the focal lens 53 (53Y, 53M, 53C, and 53K), and selectively exposes the numerous points of the peripheral surface of the photosensitive drum 21 (21Y, 21M, 21C, and 21K) which is being rotated at a predetermined peripheral velocity. As a result, an electrostatic latent image is formed on the photosensitive drum 21.

[Developing Means]

The developing means 25 (25Y, 25M, 25C, and 25K) stores in its toner container 27*b* the color developer (toner) for developing an electrostatic latent image on the photosensitive drum 21, into a visible image, as described above.

During a developing operation, the stored developer is conveyed by the toner conveying member 28 to the toner supply roller 25*b*, which is being rotated in the direction (indicated by arrow mark c), with its peripheral surface being kept in contact with the peripheral surface of the development roller 25*a*. As a result, the two surfaces rub against each other, causing thereby the developer on the peripheral surface of the toner supply roller 25*b* to transfer onto the peripheral surface of the development roller 25*a* to be borne thereon.

As the development roller 25*a* is rotated, the toner borne on the development roller 25*a* reaches the development blade 23, which regulates the amount of the toner allowed to remain adhered to the peripheral surface of the development roller 25*a*, while giving the toner a desired amount of electrical charge. As a result, the toner on the peripheral surface of the development roller 25*a* is formed into a thin layer with a predetermined thickness. As the development roller 25*a* is further rotated, the thin layer of toner is conveyed to the development station, in which the peripheral surfaces of the photosensitive drum 21 and development roller 25*a* are in contact with each other, and in which the toner is made to move from the development roller 25*a* onto the photosensitive drum 21, by the development bias (DC voltage) applied to the development roller 25*a* from a power source (unshown). As a result, the latent image on the photosensitive drum 21 is turned into a visible image (toner image, or image formed of toner).

The toner remaining on the peripheral surface of the development roller 25*a* is rubbed away from the peripheral surface of the development roller 25*a* by the toner supply roller 25*b*, and is recovered into the developing means container, in which it is mixed into the main body of the toner in the developing means container.

In the case of a contact type developing method, that is, a developing method in which the photosensitive drum 21 and development roller 25*a* are kept in contact with each other as they are in this embodiment, it is desired that the photosensitive drum 21 is rigid, whereas the development roller 25*a* is provided with an elastic layer. As this elastic layer, a single layer of solid rubber, a combination of a layer of solid rubber and a resin layer coated on the solid rubber layer in consideration of the charging of the toner, etc., are used.

[Intermediary Transfer Unit]

The intermediary transfer unit 40 comprising an intermediary transferring member 40*a* transfers in layers onto the intermediary transferring member 40*a* the toner images (visible images) formed on the photosensitive drums 21, one for one, by the developing means 25 during a color image forming operation. Thus, the intermediary transferring member 40*a* is rotated in the clockwise direction (indicated by arrow mark in FIG. 1) at the same peripheral velocity as that of the photosensitive drum 21.

The toner images formed on the photosensitive drums 21 are transferred onto the intermediary transferring member 40*a* in the primary transfer stations (T1Y, T1M, T1C, and T1K), which are the contact areas between the primary transfer rollers (42Y, 42M, 42C, and 42K) and intermediary transferring member 40*a*, respectively. Each transfer roller is positioned so that its peripheral surface is kept pressed against the peripheral surface of the photosensitive drum 21, with the transferring member 40*a* sandwiched between the two peripheral surfaces. Further, voltage is applied to the transfer roller 42.

After the multiple images are transferred in layers onto the intermediary transferring member 40*a*, the portion of the intermediary transferring member 40*a*, which is bearing the multiple images, is moved through the secondary transfer station T2, in which the intermediary transferring member 40*a* is kept in contact with a secondary transfer roller 5, along with a recording medium P, while keeping the recording medium P sandwiched between the intermediary transferring member 40*a* and the transfer roller 5. As a result, the toner images, different in color, on the intermediary transferring member 40*a* are transferred all at once in layers onto the recording medium P.

In this embodiment, the intermediary transferring member 40*a* is stretched around three rollers (shafts), that is, a drive roller 41, a counter roller 43 (roller against which secondary transfer roller 5 is kept pressed), and a tension roller 44, being thereby supported by them. The tension roller 44 is kept pressured outward of the loop of the intermediary transferring member 40*a* by the pressure applied to the lengthwise end portions of the tension roller 44 by a pair of springs, so that even if the circumferential dimension of the intermediary transferring member 40*a* changes due to changes in the temperature and/or humidity in the apparatus main assembly, and/or cumulative usage of the intermediary transferring member 40*a*, the changes in the tension of the intermediary transferring member 40*a* can be absorbed.

[Recording Medium Feeding Station]

The recording medium feed station is a station for feeding a recording medium P into the image formation station. The feed station comprises a cassette 1 storing a substantial number of recording media P, a feed roller 2, and a pair of registration rollers 3.

During an image forming operation, the feed roller 2 is rotationally driven in synchronism with the progression of the image forming operation, and the recording media P in the cassettes 1 are sequentially fed into the apparatus main assembly by the feed roller 2, while being separated. Then, each recording medium P is conveyed to the pair of registration rollers 3, which carry out, according to a predetermined sequence, the non-rotational operation, that is, the operation for keeping the recording medium P on standby, and the rotational operation, that is, the operation for releasing the recording medium P to allow the recording medium P to be conveyed toward the intermediary transferring member 40*a*. In other words, the pair of registration rollers 3 releases the recording medium P so that the recording medium P aligns with an image during the following process, that is, the image transfer process.

[Secondary Transfer Station]

The secondary transfer station T2 is provided with the secondary transfer roller 5 as described before.

More specifically, the secondary transfer roller 5 is moved by a cam (unshown), in synchronism with the transfer of color images onto the recording medium P, into the top position in which it is kept pressed against the intermediary transferring member 40*a*, with the recording medium P sandwiched between the secondary transfer roller 5 and intermediary transferring member 40*a*. At the same time, transfer bias (voltage) is applied to the transfer roller 5. As a result, the toner images on the intermediary transferring member 40*a* are transferred onto the recording medium P.

The intermediary transferring member 40*a* and secondary transfer roller 5 are individually driven. Therefore, the recording medium P is conveyed in the leftward direction of the drawing, at a predetermined speed, while remaining pinched between the intermediary transferring member 40*a* and transfer roller 5 so that the toner images are transferred onto the recording medium P. Then, the recording medium P is further conveyed to the fixation station, in which the next process is carried out.

[Fixation Station]

The fixation station 60 is a station in which the toner images which have just been transferred onto the recording medium P are fixed. The fixation station 60 comprises: a film guide unit 61 containing a ceramic heater 63 for heating the recording medium P, and a pressure roller 62 for keeping the recording medium P pressed against the film guide unit 61.

Thus, the transfer medium P bearing the transferred toner images is conveyed by the film guide unit 61 and pressure roller 62, while heat and pressure are applied to the recording medium P. As a result, the toner images are fixed to the recording medium P.

[Image Forming Operation]

Next, the image forming operation carried out by the apparatus structured as described above will be described.

First, the feed roller 2 shown in FIG. 1 is rotated to separate one of the recording media P in the cassette 1 from the rest, and the separated recording media P is conveyed to the pair of registration rollers 3.

Meanwhile, the photosensitive drum 21 and the intermediary transferring member 40*a* are rotated (in the direction indicated by an arrow mark) at a predetermined peripheral velocity (process speed).

After the peripheral surface of the photosensitive drum 21 is uniformly charged by the charge roller 22, it is exposed to the aforementioned beam of exposure light 51. As a result, a latent image is formed on the peripheral surface of the photosensitive drum 21.

Then, the latent image is developed. The above described image formation steps are carried out to form yellow, magenta, cyan, and black images in the listed order. The formed yellow, magenta, cyan, and black toner images are transferred onto the intermediary transferring member 40*a* by the corresponding primary transfer rollers (42Y, 42M, 42C, and 42K), in the primary transfer stations (T1Y, T1M, TC1, and TK1), respectively. As a result, a full-color image made up of four different toners (yellow, magenta, cyan, and black toners) is formed on the surface of the intermediary transferring member 40*a*.

The transfer roller 5 kept on standby below the counter roller 43, being thereby kept away from the intermediary transferring member 40*a* while the aforementioned four toner images different in color are formed, are moved upward by the cam (unshown), pressing thereby the transfer medium P upon the intermediary transferring member 40*a*, in the transfer station T2. Then, bias opposite in polarity from the developer is applied to the secondary transfer roller 5. As a result, the full-color image formed of the four toner images different in color, on the intermediary transferring member 40*a*, is transferred onto the transfer medium P. After being conveyed through the transfer station T2, the transfer medium P is peeled away from the intermediary transferring member 40*a*, and conveyed to the fixation station 60, in which the toner images are fixed. Thereafter, the transfer medium P is discharged by the group of discharge roller pairs 71, 72, 73, and 74 onto the delivery tray 70 on top of the apparatus main assembly B, concluding the printing of a single copy.

[Structure of Development Unit]

Next, referring to FIGS. 5–14, the development unit 20B of the process cartridge 20 will be described.

Figure 5:
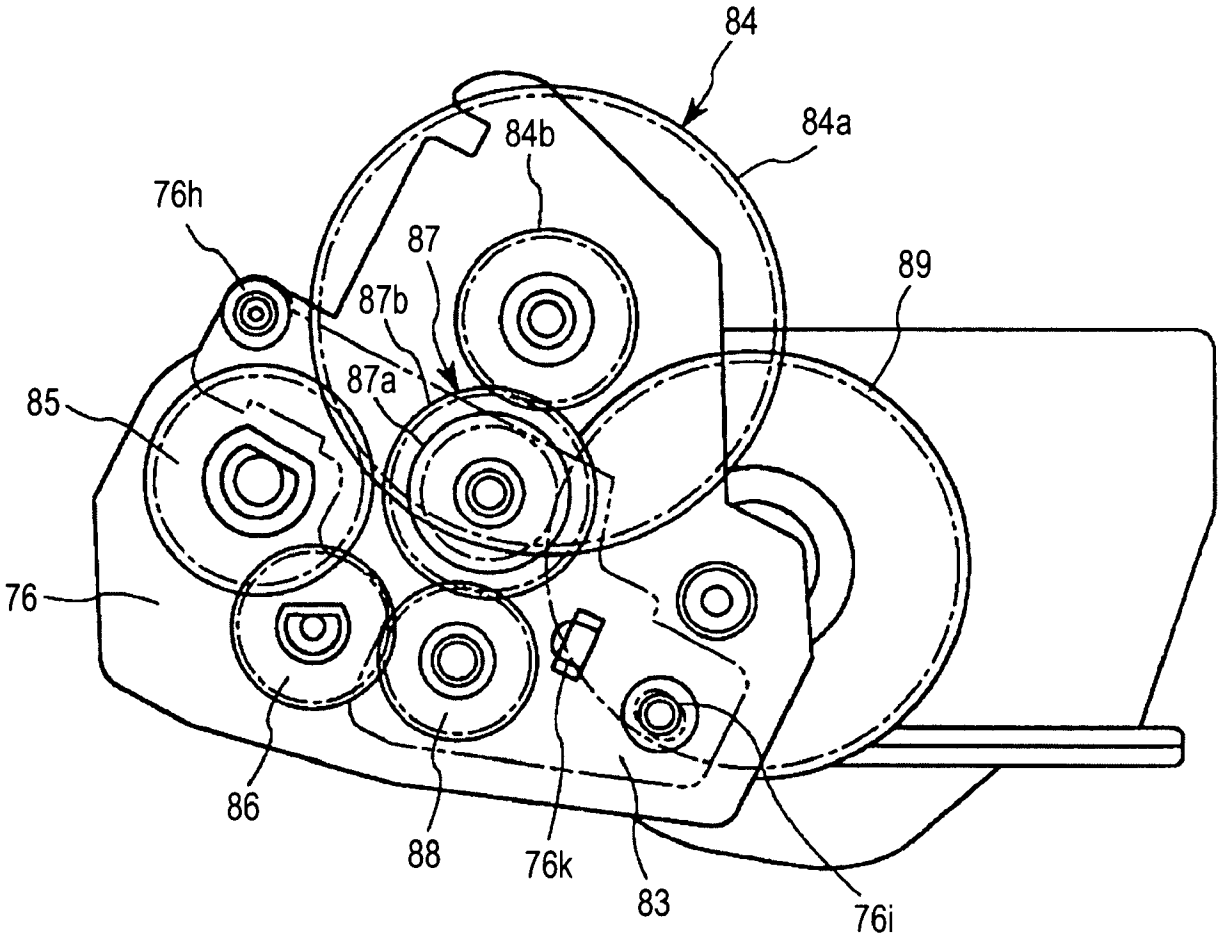
FIG. 5 is a schematic phantom side view of one of the lengthwise ends of the development unit.
Figure 6:
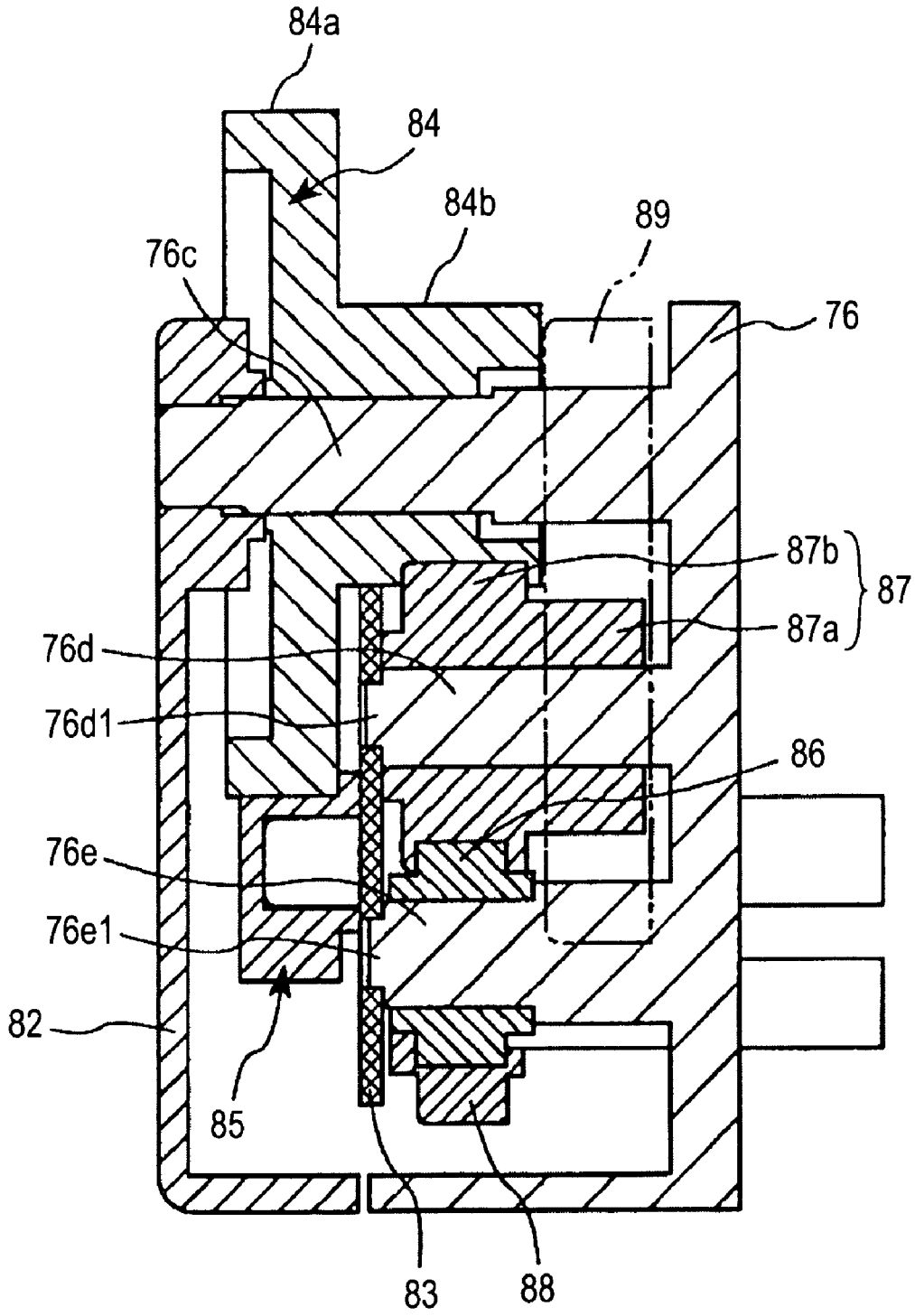
FIG. 6 is a schematic sectional view of the same lengthwise end of the development unit as the one shown in FIG. 5.
Figure 7:
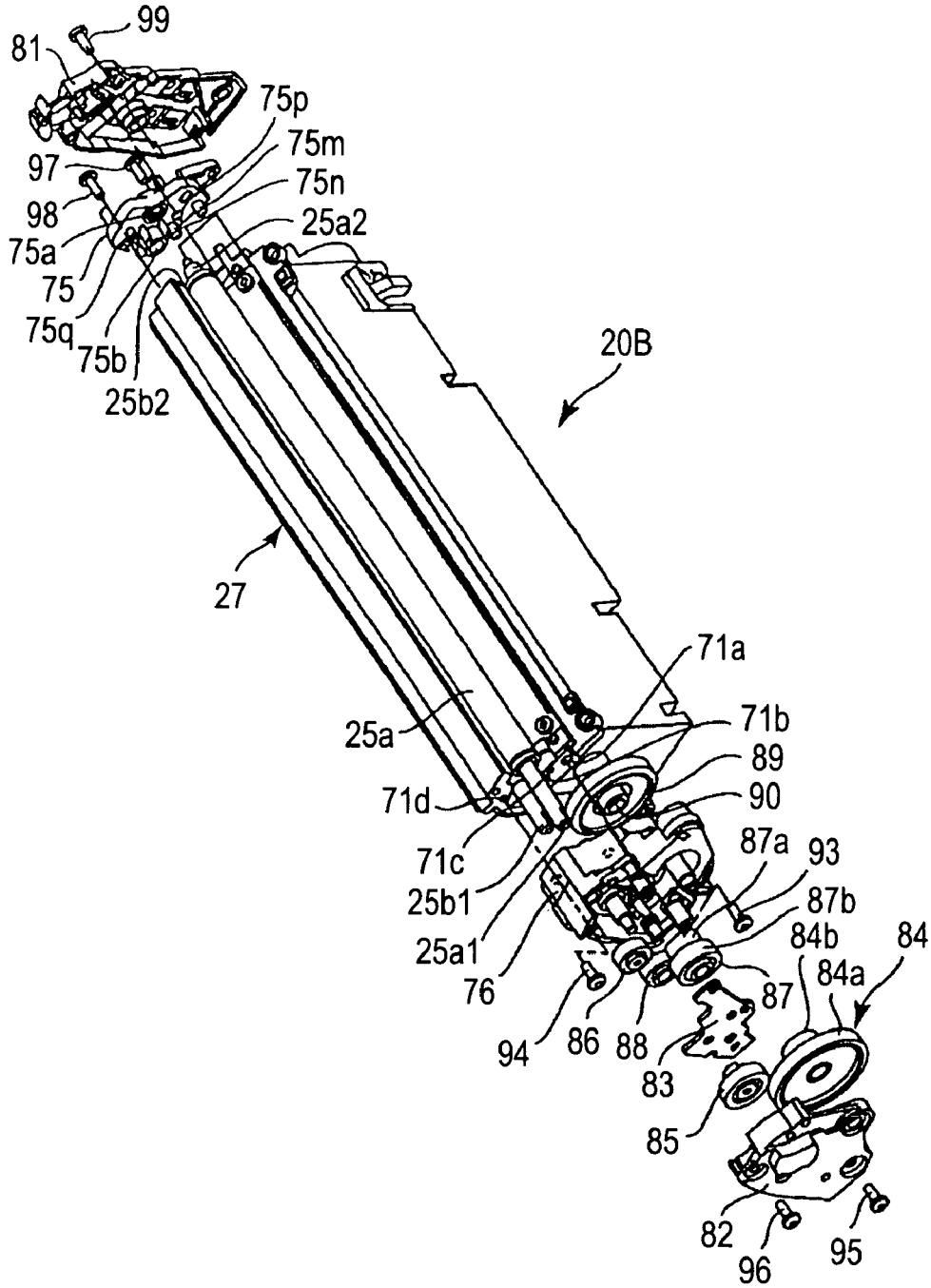
FIG. 7 is a schematic perspective view of the disassembled development unit, showing the general structure thereof.
Figure 8:
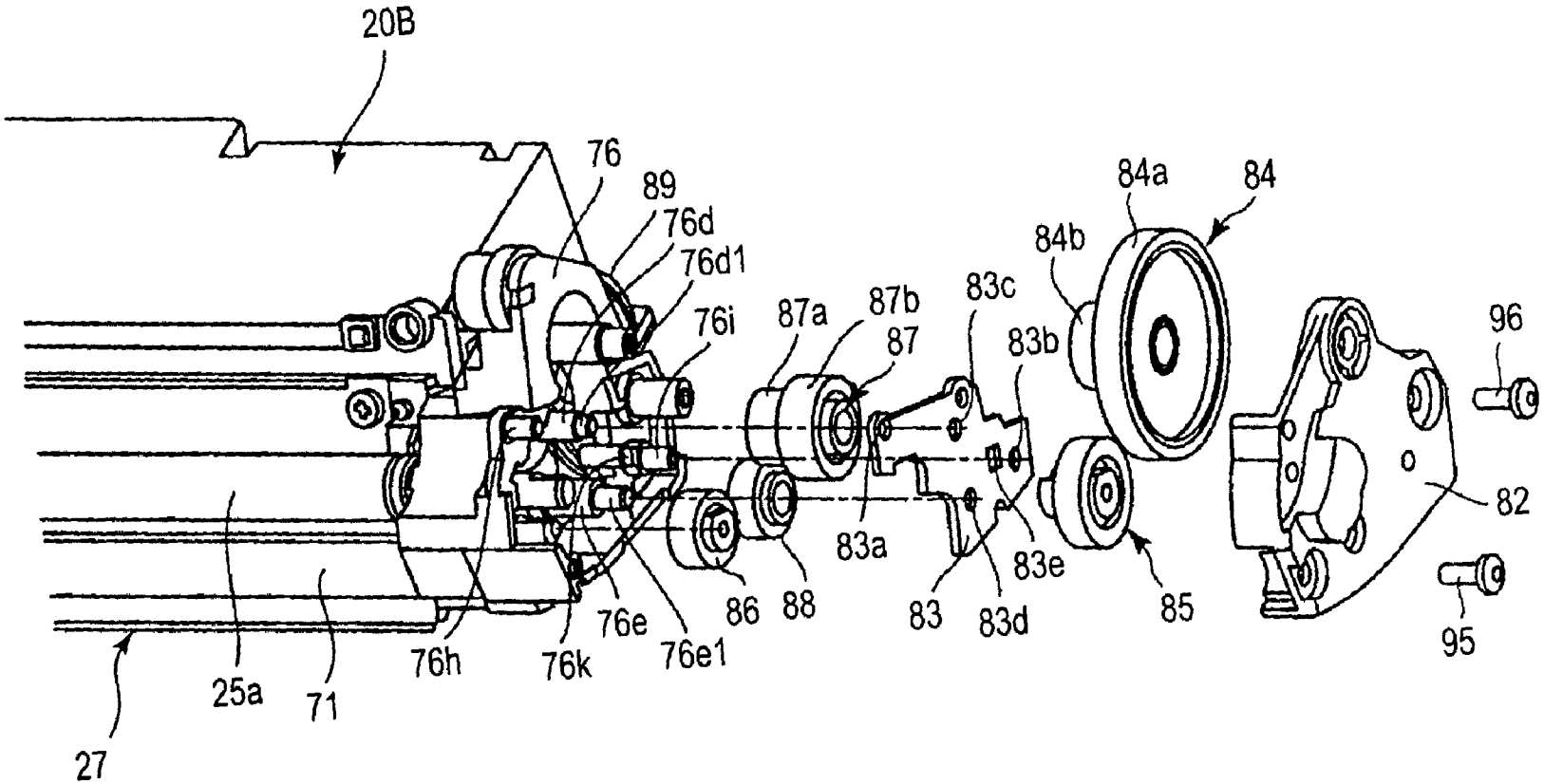
FIG. 8 is a schematic perspective view of the partially disassembled first lengthwise end of the development unit, after the attachment of the first bearing member.
Figure 9:
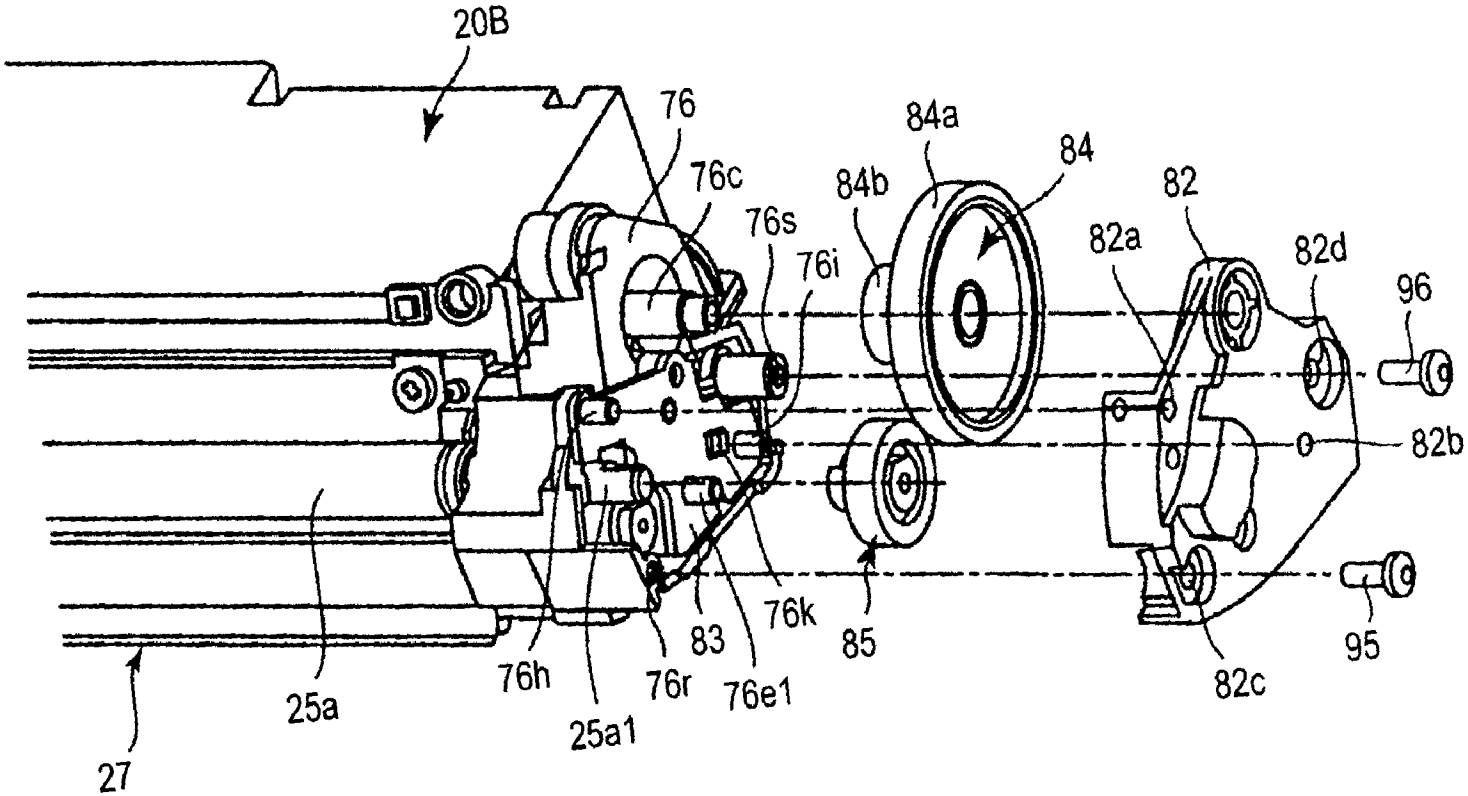
FIG. 9 is a schematic perspective view of the partially disassembled first lengthwise end of the development unit, prior to the removal, or after the attachment, of the regulating member.
Figure 10:
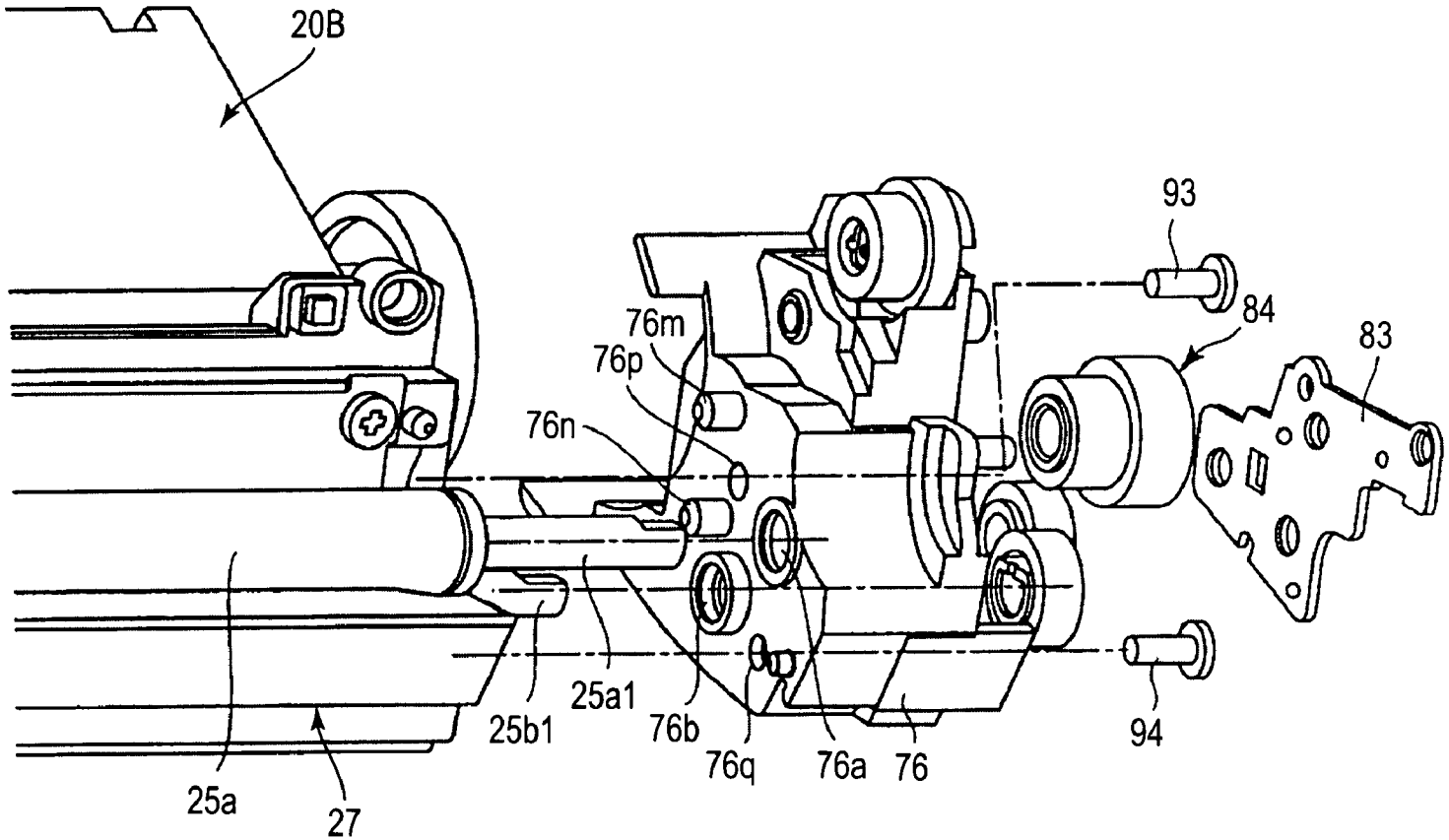
FIG. 10 is a schematic perspective view of the partially disassembled first lengthwise end of the development unit, prior to the removal, or after the attachment, of the regulating member.

FIG. 5 is a schematic side view of the development unit 20B as seen from the direction of one of the lengthwise ends of the development unit 20B, and FIG. 6 is a schematic sectional view of the lengthwise end of the development unit 20B shown in FIG. 5. FIG. 7 is a perspective view of the partially disassembled development unit 20B, showing the general structure thereof. FIGS. 8–10 are perspective views of the partially disassembled lengthwise end portion of the development unit 20B, shown in FIG. 5, different in disassembly stage and perspective.

The development unit 20B has the main frame 27 and pair of bearing members 75 and 76. The development unit frame 27 comprises the developing means container 27*a*, and the toner container 27*b* which stores toner. The bearing members 75 and 76 are located at the lengthwise ends of the developing means container 27*a*, one for one, to support the development roller 25*a* and toner supply roller 25*b*.

Referring to FIGS. 8 and 9, the development unit 20B is provided with an end cover 82 as a first end cover, bearing member 76 as a first bearing member, and a supporting or regulating member 83, which are attached to the same lengthwise end of the main frame 27 of the development unit 20B. Further, the development unit 20B is provided with a gear train which is for driving the development roller 25*a*, the toner supply roller 25*b*, and the toner conveying member 28 by receiving a driving force from a gear (unshown) of the apparatus main assembly, and which is attached to the same lengthwise end of the frame 27 as the aforementioned end to which the end cover 82, etc., are attached. In other words, a driving force reception gear 84 for receiving a driving force from the apparatus main assembly B, a development roller gear 85 with which one (which hereinafter will be referred to as first lengthwise end) of the lengthwise ends of the development roller 25*a* is fitted, a toner supply roller gear 86 with which the first lengthwise ends of the toner supply roller 25*b* is fitted, a first driving force transmission gear 87, a second driving force transmission gear 88, and a toner conveying member gear 89 with which the first lengthwise end of the toner conveying member 28 is fitted, are located at the aforementioned first lengthwise end of the development unit 20B.

The driving force reception gear 84 comprises a first driving force receiving portion 84*a*, and a second driving force receiving portion 84*b*. The first driving force transmission gear 87 comprises a first driving force transmitting portion 87*a* and a second driving force transmitting portion 87*b*.

The bearing member 76 has holes 76*a* and 76*b*, through which the aforementioned lengthwise end portion 25*a*1 of the shaft of the development roller 25*a*, and the aforementioned lengthwise end portion 25*b*1 of the shaft of the toner supply roller 25*b*, are put to be rotatably supported by the bearing member 76 (FIG. 10). Further, the bearing member 76 has gear shafts 76*c*, 76*d*, and 76*e* around which the driving force reception gear 84, the first driving force transmission gear 87, and the second driving force transmission gear 88, are fitted to be rotatably supported. In addition, the bearing member 76 has positioning projections 76*h* and 76*i* which are fitted into the holes of the regulating member 83.

The toner conveying member gear 89 is fitted around a toner conveying member gear shaft 90 rotatably supported by the development unit main frame 27.

Next, referring to FIGS. 5 and 6, the structure for transmitting driving force will be described.

The driving force reception gear 84 of the development unit 20B receives a driving force from the apparatus main assembly B, and transmits the driving force to the development roller 25*a*, the toner supply roller 25*b*, and the toner conveying member 28.

The transmission of the driving force from the driving force reception gear 84 to the development roller 25*a* is accomplished by the meshing of the driving force receiving portion 84*a* of the driving force reception gear 84 with the development roller gear 85.

As for the transmission of the driving force to the toner feeding member 28, the driving force transmission gear portion 84*b* is engaged with the second transmission gear portion 87*b* the first transmission gear portion 87*a* is engaged with the toner feeding member gear 89 to transmit the driving force.

Referring to FIG. 8, the supporting member 83 will be described.

The supporting member 83 is located at the aforementioned first lengthwise end of the development unit 20B. It is positioned outward of the first driving force transmission gear 87 for transmitting the driving force to the toner supply roller 25*b*. Further, it is positioned outward of the second driving force transmission gear 88 and the toner supply roller gear 86. The regulating member 83 in this embodiment is a piece of a metallic plate such as steel plate. Obviously, the regulating member 83 does not need to be made of steel plate; it may be made of resin, FRP (fiber-reinforced plastic), or the like.

The supporting member 83 is provided with positioning holes 83*a* and 83*b* into which the positioning projections 76*h* and 76*i* of the bearing member 76 are fitted, holes 83*c* and 83*d* into which the end portions 76*d*1 and 76*e*1 of the gear shafts 76*d* and 76*e* for supporting the first and second driving force transmission gears 87 and 88 are fitted, and hole 83*e* into which an elastic claw or locking portion 76*k*, as the supporting member retaining member or portion, of the bearing member 76 engages.

The supporting member 83 is precisely positioned relative to the development unit main frame 27, as the positioning projections 76*h* and 76*i* of the bearing member 76 are fitted into the positioning holes 83*a* and 83*b* of the supporting member 83. As for the holes 83*c* and 83*d* of the regulating member (supporting member) 83, the end portions 76*d*1 and 76*e*1 of the bearing member 76 fit into them, one for one.

The gear shaft 76*d* for supporting the first driving force transmission gear 87 cannot be supported by the shaft attached to the end cover 82, because of the presence of the driving force reception gear 84 between the first driving force transmission gear 87 and the end cover 82. However, the end portion of the gear shaft 76*d* is fitted in the hole of the supporting member 83, being thereby prevented from wobbling when the driving force is transmitted to the first driving force transmission gear 87. As for the gear shaft 76*e* for supporting the second driving force transmission gear 88, no gear is present between it and the end cover 82, and therefore, it is supported by the gear shaft 76*e* supported by the supporting member 83 and the end cover 82. However, the second driving force transmission gear 88 may be supported by a gear shaft attached to only one of the supporting member 83 and the end cover 82.

The elastic claw 76*k* (supporting member retaining portion) of the bearing member 76 is fitted in the hole 83*e* of the supporting member 83, making it thereby difficult for the supporting member 83 to become separated from the bearing member 76.

The supporting member 83 is sandwiched between the bearing member 76 and the end cover 82; parts (portions surrounding positioning holes) of the supporting member 83 are placed in contact with the end cover 82, keeping thereby the supporting member 83 kept pressed on the bearing member 76.

Next, referring to FIGS. 3–14, the method, in this embodiment of the present invention, for remanufacturing the process cartridge 20 will be described.

[Development Unit Assembly Method]

Next, referring to the aforementioned FIGS. 7–10, 11, and 12, the structural arrangement for attaching the bearing members 75 and 76, groups of gears as driving force transmitting means, and end covers 81 and 82 to the development unit main frame 27, and the method for attaching them, will be described.

Figure 11:
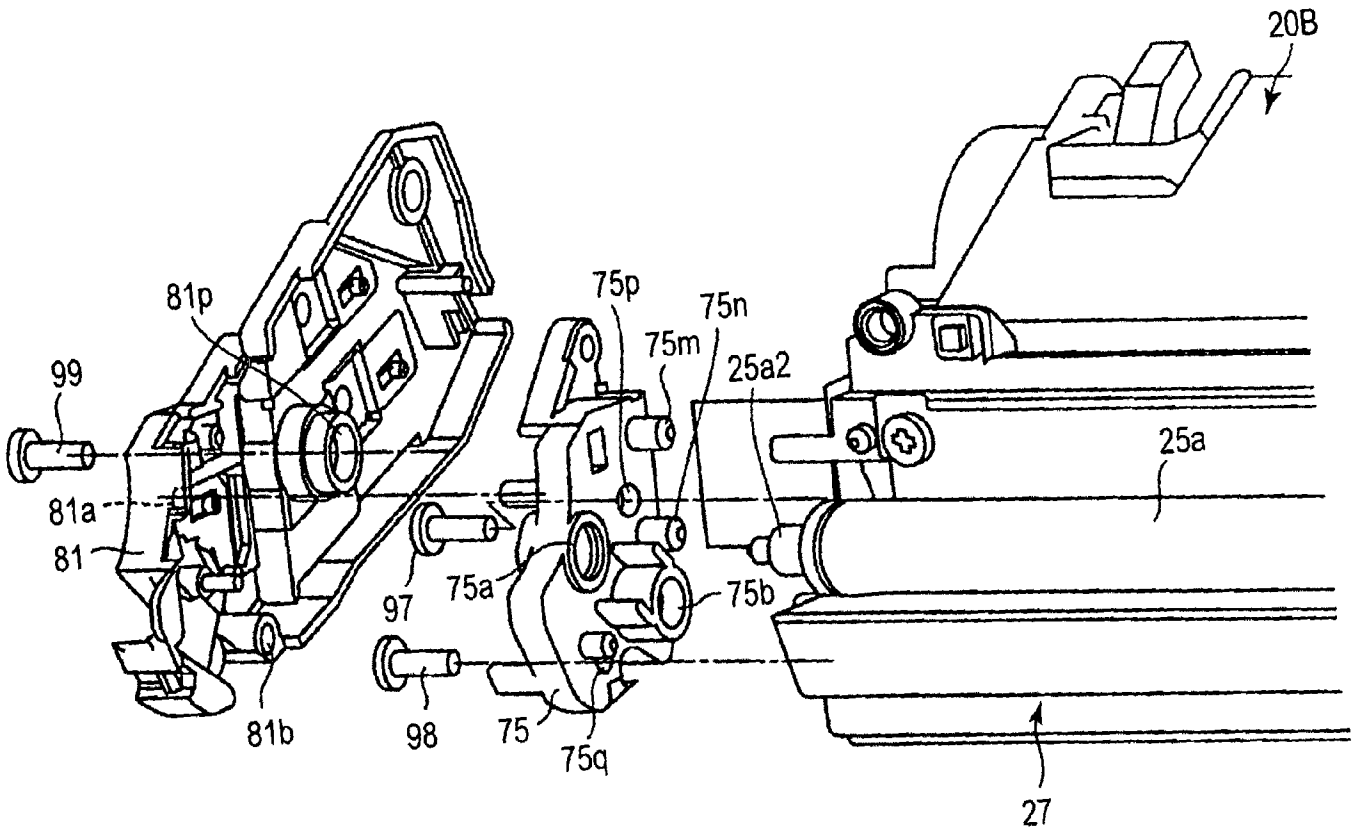
FIG. 11 is a schematic perspective view of the disassembled second lengthwise end of the development unit, showing the second bearing member and second end cover.
Figure 12:
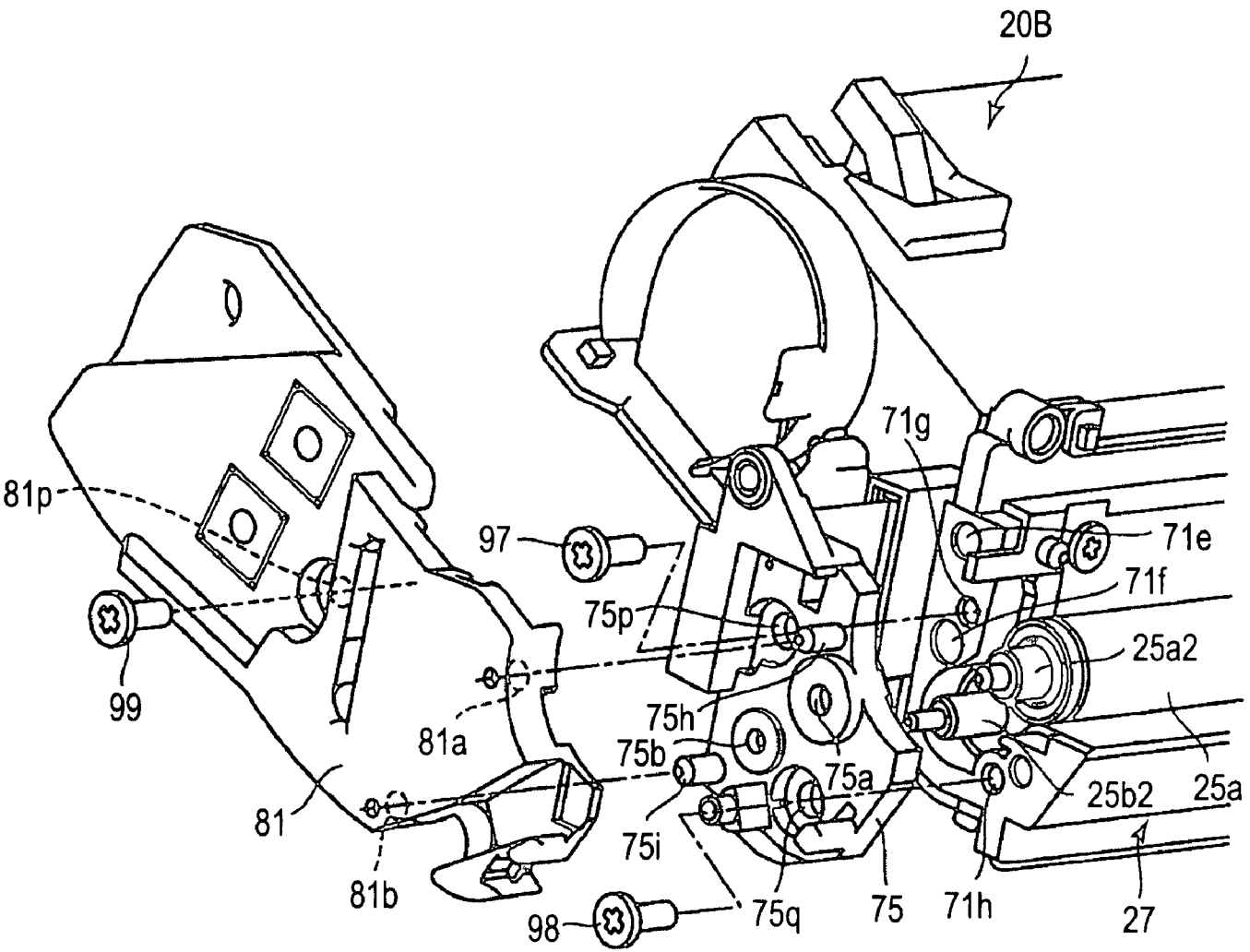
FIG. 12 is a schematic perspective view of the disassembled second lengthwise end of the development unit, showing the second bearing member and second end cover.

FIGS. 11 and 12 are schematic perspective views, different in perspective, of the partially disassembled second lengthwise end portion of the development unit 20B, depicting the bearing member 75 (second bearing member) and the end cover 81 (second end cover) located at the second lengthwise end of the development unit 20B.

The first lengthwise end portion of the developing means container 27*a* of the development unit main frame 27 is provided with positioning holes 71*a* and 71*b*, and screw holes 71*c* and 71*d*. Further, the bearing member 76 is provided with positioning projections 76*m* and 76*n* (FIG. 10), which fit into the positioning-holes 71*a* and 71*b* of the developing means container 27*a*.

First, the method for attaching the bearing member 76 to the development unit main frame 27 will be described.

Though the through holes 76*a* and 76*b* of the bearing member 76, the first lengthwise end portion 25*a*1 of the development roller 25*a*, and the first lengthwise end portion 25*b*1 of the toner supply roller 25*b*, are put. As a result, the first lengthwise end portion 25*a*1 of the development roller 25*a*, and the first lengthwise end portion 25*b*1 of the toner supply roller 25*b*, are rotatably supported by the bearing member 76 (roller attachment process).

Next, the projections 76*m* and 76*n* are fitted into the holes 71*a* and 71*b*, accurately positioning the bearing member 76 relative to the developing means container 27*a*. Then, the bearing member 76 is screwed to the developing means container 27*a* with the use of screws 93 and 94. The screws 93 and 94 are put through the through holes 76*p* and 76*q*, and screwed into the screw holes 71*c* and 71*d* of the developing means container 27*a*, solidly fixing the bearing member 76 to the developing means container 27*a*.

Next, the method for attaching the toner supply roller gear 86, the first driving force transmission gear 87, and the second driving force transmission gear 88, and the supporting member 83 will be described.

First, the toner supply roller gear 86 is fitted around the first lengthwise end portion 25*b*1 of the shaft of the toner supply roller 25*b* (toner conveying gear attachment process).

The first driving force transmission gear 87 is fitted around the gear shaft 76*d* of the bearing member 76, being rotatably supported by the bearing member 76 (gear shaft 76*d*). The first driving force transmitting portion 87*a* of the first driving force transmission gear 87 meshes with the toner conveying member gear 79. The second driving force transmission gear 88 is fitted around the gear shaft 76*e* of the bearing member 76, being rotatably supported by the bearing member 76 (gear shaft 76*e*). Further, the second driving force transmission gear 88 meshes with the second driving force transmitting portion 87*b* of the first driving force transmission gear 87, and the toner supply roller gear 86.

As described above, the supporting member 83 is accurately positioned relative to the bearing member 76, as the positioning projections 76*h* and 76*i* of the bearing member 76 fit into the positioning holes 83*a* and 83*b* of the supporting member 83. Further, the end portion 76*d*1 of the gear shaft 76*d* of the bearing member 76, and the end 76*e*1 portion of the gear shaft 76*e* of the bearing member 76, fit into the positioning holes 83*c* and 83*d* of the supporting member in 83, preventing thereby the gear shafts 76*d* and 76*e* from wobbling when the driving force is transmitted, and also, assuring that the distance between the rotational axes of the gear 88 and 87 is kept constant (second gear attachment process, and third gear attachment process).

The first driving force transmission gear 87 and the second driving force transmission gear 88, and toner supply roller gear 86 are at least partially covered by the supporting member 83. Further, as the supporting member 83 is brought to the bearing member 76 to be attached to the bearing member 76, the claw 76*k* of the bearing member 76 is elastically bent, and then, snaps into the hole 83*e* of the supporting member 83, firmly holding the supporting member 83 to the bearing member 76 while making it thereby difficult for the supporting member 83 to become separated from the bearing member 76. Therefore, it is unlikely for the first driving force transmission gear 87, the second driving force transmission gear 88, and the toner supply roller gear 86 to become disengaged from the bearing member 76 (supporting member attachment process).

Next, the method for attaching the development roller gear 85, the driving force reception gear 84, and the end cover 82 will be described.

The development roller gear 85 is fitted around the aforementioned shaft 25*a*1, and the driving force reception gear 84 is fitted around the gear shaft 76*c* of the bearing member 76, being thereby rotatably supported by the bearing member 76 (gear shaft 76*c*) (first gear attachment process).

The development roller gear 85 meshes with the first driving force receiving portion 84*a* of the driving force reception gear 84, and the second driving force receiving portion 84*b* of the driving force reception gear 84 meshes with the second driving force transmitting portion 87*b* of the first driving force transmission gear 87.

Next, the positioning projections 76*h* and 76*i* of the bearing member 76 are fitted into the positioning holes 82*a* and 82*b* of the end cover 82, accurately positioning thereby the end cover 82 relative to the bearing member 76. Then, the end cover 82 is screwed to the bearing member 76 with the use of the screws 95 and 96 (cover attachment process). The screws 95 and 96 are put through the through holes 82*c* and 82*d* of the end cover 82, and screwed into the screw holes 76*r* and 76*s* of the bearing member 76, securely fixing the end cover 82 to the bearing member 76.

Next, referring to FIGS. 7, 11, and 12, the method for attaching the bearing member 75 (second bearing member), or the bearing member located at the opposite lengthwise end (second lengthwise end) of the development unit 20B from the bearing member 76, and the end cover 81 (second end cover), or the end cover located at the opposite lengthwise end (second lengthwise end) of the development unit 20B from the end cover 82, to the development unit main frame 27, will be described.

First, the second end portion 25*a*2 and second end portion 25*b*2 of the shafts of the development roller 25*a* and toner supply roller 25*b*, respectively, are put through the holes 75*a* and 75*b* of the bearing member 75, being thereby rotatably supported by the bearing member 75.

Next, the positioning projections 75*m* and 75*n* of the bearing member 75 are fitted into the positioning holes 71*e* and 71*f* of the development unit main frame 27 located at the second lengthwise end of the development unit main frame 27.

As a result, the bearing member 75 is accurately positioned relative to the developing means container 27*a*. Thereafter, the bearing member 75 is screwed to the development unit main frame 27 with the use of the screws 97 and 98. The screws 97 and 98 are put through the through holes 75*p* and 75*q* of the bearing member 75, and screwed into the screw holes 71*g* and 71*h* of the development unit main frame 27, securely fixing the bearing member 75 to the developing means container 27*a*.

Next, the method for attaching the second end cover 81 will be described.

Into the positioning holes 81*a* and 81*b* of the end cover 81, the positioning projections 75*h* and 75*i* of the bearing member 75 are put, accurately positioning the end cover 81 relative to the bearing member 75. Then, the end cover 81 is screwed to the development unit main frame 27 with the use of the screw 99. The screw 99 is put through the through hole 81*p* of the end cover 81, and screwed into the screw hole of the development unit main frame 27, securely fixing the end cover 81 to the development unit main frame 27.

The embodiments of the assembling method is summarized as having the following steps:

(A) a roller mounting step of mounting the one end bearing member 76 to the one longitudinal end of the main developing device frame 27 while supporting, to the one end bearing member 76, one end 25*a*1 of the developing roller 25*a* for developing the electrostatic latent image formed on the electrophotographic photosensitive drum 21 and the one end 25*b*1 of the developer supplying roller 25*b* for supplying the developer to the developing roller 25*a*, and mounting the other end bearing member 75 to the other longitudinal end of the main developing device frame 27 while supporting, on the other end bearing member 75, the other end 25*a*2 of the developing roller 25*a* and the other end 25*b*2 of the developer supplying roller 25*b;*

(B) a driving force transmission gear mounting step of mounting, to the one end bearing member 76 mounted to the one longitudinal end of the main developing device frame 27, the first driving force transmission gear 87 and the second driving force transmission gear 88 for transmitting the driving force received from the main assembly of the apparatus to the developer supplying roller 25*b;*

(C) a regulating member mounting step of mounting the regulating member 83 outside the first driving force transmission gear 87, the second driving force transmission gear 88 and the developer supplying roller gear 86 with respect to the longitudinal direction of the main developing device frame 27 to the one end bearing member 76 to which the first driving force transmission gear 87, the second driving force transmission gear 88 and the developer supplying roller gear 86 are mounted, such that it overlaps at least partly with the first driving force transmission gear 87, the second driving force transmission gear 88 and the developer supplying roller gear 86.

Here, the regulating member 83 is mounted to the one end bearing member 76 by engagement of the gear shaft holes 83*c*, 83*d* of the regulating member 83 with the gear shaft 76*d* (shaft end portion 76*d*1) of the first driving force transmission gear 87 and the gear shaft 76*e* (shaft end portion 76*e*1) of the second driving force transmission gear 88, and by engagement of the positioning holes 83*a*, 83*b* of the regulating member 83 with positioning projections 76*h*, 76*i* of the one end bearing member 76. The method further comprises (D) a one end covering member mounting step of mounting the one end covering member 82 to the one end bearing member 76 so as to interpose the regulating member 83 therebetween and to partly contact the regulating member 83 to confine the regulating member 83 to the one end bearing member 76.

Here, the one end covering member 82 is engaged with the positioning projections 76*h*, 76*i* to determine the mounting position relative to the one end bearing member 76.

In the regulating member mounting step, the regulating member 83 may be locked with the locking hole 83*e* of the regulating member 83 such that locking portion 76*k* provided on the one end bearing member 76 is elastically locked.

The assemblying method may further comprise a toner feeding member gear mounting step, prior to the roller mounting step, of mounting the toner feeding member gear 89 for transmitting the driving force received from the main assembly of the apparatus to the toner feeding member 28 for feeding the developer accommodated in the developer accommodating portion 27*b* at the one longitudinal end of the developing device frame 27.

The assemblying method further comprises, after the regulating member mounting step, a driving force reception gear mounting step of mounting the driving force reception gear 84 for receiving the driving force from the main assembly of the apparatus when the process cartridge 20 is mounted to the main assembly of the apparatus to the gear shaft 76*c* provided on the one end bearing member 76, and a developing roller gear mounting step of mounting the developing roller gear 85 for transmitting the driving force received from the main assembly of the apparatus by the driving force reception gear 84 to the developing roller 25*a*, wherein after the driving force reception gear 84 and the developing roller gear 85 are mounted to the one end bearing member 76, the one end covering member 82 is mounted to the one end bearing member 76.

The order in which the above described development assembly processes are carried out is optional; it may be discretionarily changed.

As will be evident from the above descriptions of the preferred embodiments of the present invention, the present invention offers the following effects.

It is assured that the gears as the means for transmitting the force for driving a process cartridge are properly supported by the gear shafts. Therefore, driving force is properly transmitted, and also, a process cartridge can be reduced in size.

The supporting member at least partially covers the first driving force transmission gear, the second driving force transmission gear, and the developer supply roller gear, and is attached to the first bearing member, preventing thereby these gears from accidentally falling off. Therefore, more latitude is afforded in terms of the cartridge attitude during the assembly thereof, as well as the order in which the cartridge assembly processes are carried out, improving thereby process cartridge assembly efficiency.

Further, not only is the above described method for assembling a process cartridge employable for manufacturing process cartridges, but also for reassembling the components from used process cartridges, after the used process cartridges are disassembled, and their components are examined to be reused, or replaced with new ones, for their remanufacture. The results of such an employment are the same as those described above.

As described above, the present invention makes it possible to reduce the size of a process cartridge. It also makes it possible to precisely support the second gear for transmitting the driving force received by the first gear to the development supply roller. Further, it improves process cartridge assembly efficiency.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 400799/2003, filed Nov. 28, 2003, which is hereby incorporated by reference.

What is claimed is:

1. A process cartridge detachably mountable to a main assembly of an electrophotographic image forming apparatus, said process cartridge comprising:

an electrophotographic photosensitive drum;

a developer accommodating portion configured to accommodate a developer;

a developing roller configured and positioned to develop an electrostatic latent image formed on said electrophotographic photosensitive drum using the developer accommodated in said accommodating portion;

a developer supply roller configured and positioned to supply the developer to said developing roller;

a developing device frame supporting said developing roller and said developer supply roller and having said developer accommodating portion;

a first gear provided at one longitudinal end side of said developing device frame, said first gear having a driving force receiving gear portion which is engaged with a main assembly gear provided in the main assembly of the image forming apparatus when said process cartridge is mounted to the main assembly of the image forming apparatus;

a second gear provided inside said driving force receiving gear portion in a longitudinal direction of said developing device frame, said second gear being effective to transmit the driving force received by said first gear to said developer supply roller; and a supporting member, disposed between said first gear and said second gear with respect to the longitudinal direction of said developing device frame, configured and positioned to support said second gear.

2. A process cartridge according to claim 1, further comprising a covering member which is mounted to an outside of said supporting member with respect to the longitudinal direction of said developing device frame, and which is mounted to said developing device frame with said supporting member interposed therebetween.

3. A process cartridge according to claim 2, wherein said covering member supports one end side of said first gear with respect to the longitudinal direction.

4. A process cartridge according to claim 2 or 3, wherein said covering member supports one end side of a first gear supporting shaft supporting said first gear and provided on said developing device frame with respect to the longitudinal direction.

5. A process cartridge according to claim 1, wherein said supporting member supports one end side of a second gear supporting shaft supporting said second gear provided on said developing device frame with respect to the longitudinal direction.

6. A process cartridge according to claim 1, wherein said driving force receiving gear portion has a region in which said driving force receiving gear portion is overlapped with said second gear with respect to the longitudinal direction.

7. A process cartridge according to claim 1, wherein said driving force receiving gear portion has a region which is overlapped with a center of rotation of said second gear with respect to the longitudinal direction.

8. A process cartridge according to claim 1, wherein said supporting member has an engaging hole engageable with a locking portion provided on said developing device frame.

9. A process cartridge according to claim 1, wherein said first gear has a transmission gear portion configured and positioned to transmit the driving force by engagement with said second gear.

10. A process cartridge according to claim 1, wherein said supporting member is a metal plate.

11. A process cartridge according to claim 1, further comprising a third gear, provided inside said driving force receiving gear portion with respect to the longitudinal direction of said developing device frame, configured and positioned to transmit the driving force to said developer supply roller, wherein said supporting member is overlapped with at least a part of said third gear with respect to the longitudinal direction.

12. A process cartridge according to claim 11, wherein said supporting member supports one end side of a third gear supporting shaft supporting said third gear provided on said developing device frame with respect to the longitudinal direction.

13. A process cartridge according to claim 11, wherein said third gear functions as a developer supply roller gear engaged with an idler gear engaged with said second gear and an idler gear provided at one end of said developer supply roller.

14. A process cartridge according to claim 1, wherein said developing device frame has a bearing member at one longitudinal end, wherein said first gear, said second gear and said supporting member are provided on said bearing member.

15. A process cartridge according to claim 2, wherein said covering member supports one end side of a first gear supporting shaft supporting said first gear provided on a bearing member with respect to the longitudinal direction, and said covering member is fixed on said bearing member with said supporting member interposed therebetween.

16. An assembling method for a process cartridge detachably mountable to a main assembly of an electrophotographic image forming apparatus, wherein the process cartridge includes an electrophotographic photosensitive drum, a developer accommodating portion configured to accommodate a developer, a developing roller configured and positioned to develop an electrostatic latent image formed on the electrophotographic photosensitive drum using the developer accommodated in the developer accommodating portion, a developer supply roller configured and positioned to supply the developer to the developing roller, and a developing device frame supporting the developing roller and the developer supply roller and having the developer accommodating portion, said method comprising:

(i) a roller mounting step of mounting the developing roller and the developer supply roller to the developing device frame;

(ii) a second gear mounting step of mounting a second gear to the developing device frame, wherein the second gear is effective to transmit a driving force received by a first gear engaged with a main assembly gear provided in the main assembly of the image forming apparatus to the developer supply roller;

(iii) a supporting member mounting step of mounting a supporting member to the developing device frame to support the second gear by the supporting member after said second gear mounting step, wherein the supporting member is disposed between the first gear and the second gear with respect to a longitudinal direction of the developing device frame to support the second gear; and (iv) a first gear mounting step of mounting the first gear to the developing device frame after said supporting member mounting step.

17. A method according to claim 16, further comprising a covering member mounting step of mounting a covering member to the developing device frame with the supporting member interposed therebetween with respect to a longitudinal direction of the developing device frame, after said first gear mounting step.

18. A method according to claim 16, further comprising a toner feeding member gear mounting step of mounting a toner feeding member gear for transmitting a driving force received from the main assembly gear to a toner feeding member for feeding the developer accommodated in said developer accommodating portion at one longitudinal end of said developing device frame, prior to said roller mounting step.

19. A method according to claim 16, further comprising a third gear mounting step of mounting to the developing device frame a third gear configured and positioned to transmit a driving force to the developer supply roller by engagement with the second gear, after said second gear mounting step.

20. A method according to claim 16, wherein in said roller mounting step, the developing roller and the developer supply roller are mounted to a bearing member of the developing device frame positioned at one longitudinal end side thereof, wherein in said second gear mounting step, the second gear is mounted to the bearing member, and wherein in said supporting member mounting step, the supporting member is mounted to the bearing member.

* * * * *

UNITED STATES PATENT AND TRADEMARK OFFICE

CERTIFICATE OF CORRECTION

PATENT NO. : 7,027,756 B2
APPLICATION NO. : 10/878616
DATED : April 11, 2006
INVENTOR(S) : Nobuharu Hoshi et al.

It is certified that error appears in the above-identified patent and that said Letters Patent is hereby corrected as shown below:

ON THE TITLE PAGE:
At Item (56), U.S. Patent Documents, --5,634,178 5/1997 Sugiura et al. 399/110-- should be inserted.

COLUMN 2:
Line 38, “first” should read --first gear--.

COLUMN 9:
Line 4, “are moved” should read --is moved--.

COLUMN 11:
Line 49, “positioning-holes” should read --positioning holes--.
Line 54, “Though” should read --Through--.

COLUMN 12:
Line 28, “76e1” should be deleted.
Line 29, “portion” should read --portion 76e1--.

COLUMN 13:
Line 48, “method is” should read --method are--.

Signed and Sealed this

Tenth Day of July, 2007

JON W. DUDAS
*Director of the United States Patent and Trademark Office*